US006707204B2

(12) United States Patent
Odachi et al.

(10) Patent No.: US 6,707,204 B2
(45) Date of Patent: Mar. 16, 2004

(54) ROTATIONAL UNIT

(75) Inventors: Yasuharu Odachi, Kariya (JP); Taku Adaniya, Kariya (JP); Hirohito Hayashi, Kariya (JP); Masaki Ota, Kariya (JP); Takahiro Suzuki, Kariya (JP); Masahiro Kawaguchi, Kariya (JP); Akinobu Kanai, Kariya (JP); Takeshi Kawata, Kariya (JP); Masanori Sonobe, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/132,973

(22) Filed: Apr. 26, 2002

(65) Prior Publication Data

US 2002/0158526 A1 Oct. 31, 2002

(30) Foreign Application Priority Data

Apr. 27, 2001 (JP) ..... 2001-132936
Jul. 24, 2001 (JP) ..... 2001-223522

(51) Int. Cl.[7] ..... H02K 49/00
(52) U.S. Cl. ..... 310/102 R; 417/362; 417/16
(58) Field of Search ..... 370/75 R, 76, 370/78, 82, 92, 96, 100, 102 R–102 A, 112, 113; 417/362, 16

(56) References Cited

U.S. PATENT DOCUMENTS 4,654,551 A * 3/1987 Farr ..... 310/112
6,164,929 A * 12/2000 Kazuya et al. ..... 417/362
6,193,473 B1 * 2/2001 Mruk et al. ..... 417/350

FOREIGN PATENT DOCUMENTS

JP 6-87678 12/1994 ..... F04B/27/08
JP 2001-20859 1/2001 ..... F04B/35/00
JP 2001-140757 5/2001 ..... F04B/35/00

* cited by examiner

*Primary Examiner*—Dang Le
(74) *Attorney, Agent, or Firm*—Morgan & Finnegan, LLP

(57) ABSTRACT

A mechanical rotational device includes a housing. An end portion of a rotary shaft protrudes from a front wall of the housing. An electric rotational device is coaxial with the rotary shaft and is coupled to the end portion of the rotary shaft. The electric rotational device functions as at least one of a motor and a generator. A rotational member is coupled to the rotary shaft and has a power transmitting mechanism for transmitting power between the rotational unit and an external device. A one-way clutch is located in the power transmitting path between the rotary shaft and rotational member. The one-way clutch is located inward of the rotational member. The electric rotational device is located on or forward of the housing. At least part of the electric rotational device is located outward of the power transmitting mechanism.

16 Claims, 3 Drawing Sheets

ROTATIONAL UNIT

BACKGROUND OF THE INVENTION

The present invention relates to a rotational unit having a mechanical rotational device; an electric rotational device, which is coupled to the rotary shaft of the mechanical rotational device and functions as at least one of a motor and a generator; and a rotational member, which is coupled to the rotary shaft and has a power transmitting mechanism located at the periphery of the rotational member for transmitting power between the rotational unit and an external device.

Japanese Laid-Open Utility-Model Publication No. 6-87678 discloses such a rotational unit.

In the rotational unit disclosed in the publication, the rotary shaft of a mechanical rotational device (the compression mechanism of a hybrid compressor) is coupled to an electric rotational device (a motor). A rotational member (a pulley) is also coupled to the rotary shaft for transmitting power from an external device (an engine). An electromagnetic clutch is located between the rotational member and the rotary shaft to selectively transmit power.

As the electromagnetic clutch is engaged and disengaged, the mechanical rotational device is driven by the force of the engine and the rotor of the electric rotational device is rotated to generate electricity, and the mechanical rotational device is driven by the force of the electric rotational device.

The rotational member is coupled to a power transmitting mechanism. A belt is engaged with the power transmitting mechanism to transmit power of the engine to the rotational member. The electric rotational device is displaced from the power transmitting mechanism in the axial direction of the rotary shaft.

The rotor of the electric rotational device includes permanent magnets. The electric rotational device also includes a stator part, which is formed with a conductor wire. The electric rotational device is driven by electricity supplied from a battery connected to the conductor wire. Also, the battery is charged with electricity generated by the electric rotational device.

Although the electric rotational device is axially displaced from the power transmission, the radial dimension of the electric rotational device is not increased to increase the power. Also, since the electromagnetic clutch is formed with relatively large members such as electromagnets, the size of the rotational member is increased. When the electromagnetic clutch is engaged or disengaged, the clutch is controlled by external electric signals, which complicates the structure.

When the mechanical rotational device is driven by the engine, the rotor is dragged along and rotated. At this time, since the rotor includes permanent magnets and magnetic force of the rotor acts on the stator, heat is generated due to excitation loss of the stator, which causes energy loss. When the rotor is dragged along and rotated, the force between the permanent magnets and the stator changes due to changes in distances between the poles of the permanent magnets and the poles of the stator. This fluctuates the torque acting on the rotary shaft and thus generates rotational vibration.

Current generated by the electric rotational device may be smoothed. To smooth the current, a capacitor may be connected to the battery in parallel. Even if the battery is disconnected from the capacitor by a relay when the battery need not be charged, the electricity continues to be generated as long as the rotor is dragged along and rotated.

Accordingly, the voltage between the terminals of the capacitor becomes excessive, which may damage the capacitor. Therefore, the voltage between the terminals of the capacitor needs to be controlled such that it does not become excessive, which complicates the structure.

SUMMARY OF THE INVENTION

Accordingly, it is a first objective of the present invention to provide a compact and simple rotational unit that permits the size of an electric rotational device to be increased regardless of the size of a power transmitting mechanism to increase the power of the electric rotational device. A second objective of the present invention is to provide a rotational unit that reduces energy loss when a mechanical rotational device is driven by an external drive source and suppresses rotational vibrations of a rotary shaft.

To achieve the foregoing and other objectives and is accordance with the purpose of the present invention, a rotational unit having a mechanical rotational device, a rotary shaft, an electric rotational device, a rotational member, a one-way clutch is provided. The mechanical rotational device has a housing. The housing includes a front wall. The rotary shaft has an end portion that protrudes from the front wall of the housing. The electric rotational device is coaxial with the rotary shaft. The electric rotational device is coupled to the end portion of the rotary shaft and functions as at least one of a motor and a generator. The rotational member is coupled to the rotary shaft and has a power transmitting mechanism for transmitting power between the rotational unit and an external device. The a one-way clutch is located in a power transmitting path between the rotary shaft and the rotational member. The one-way clutch is located inward of the rotational member. The electric rotational device is located on or forward of the front wall of the housing. At least part of the electric rotational device is located outside the outer dimension of the power transmitting mechanism.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
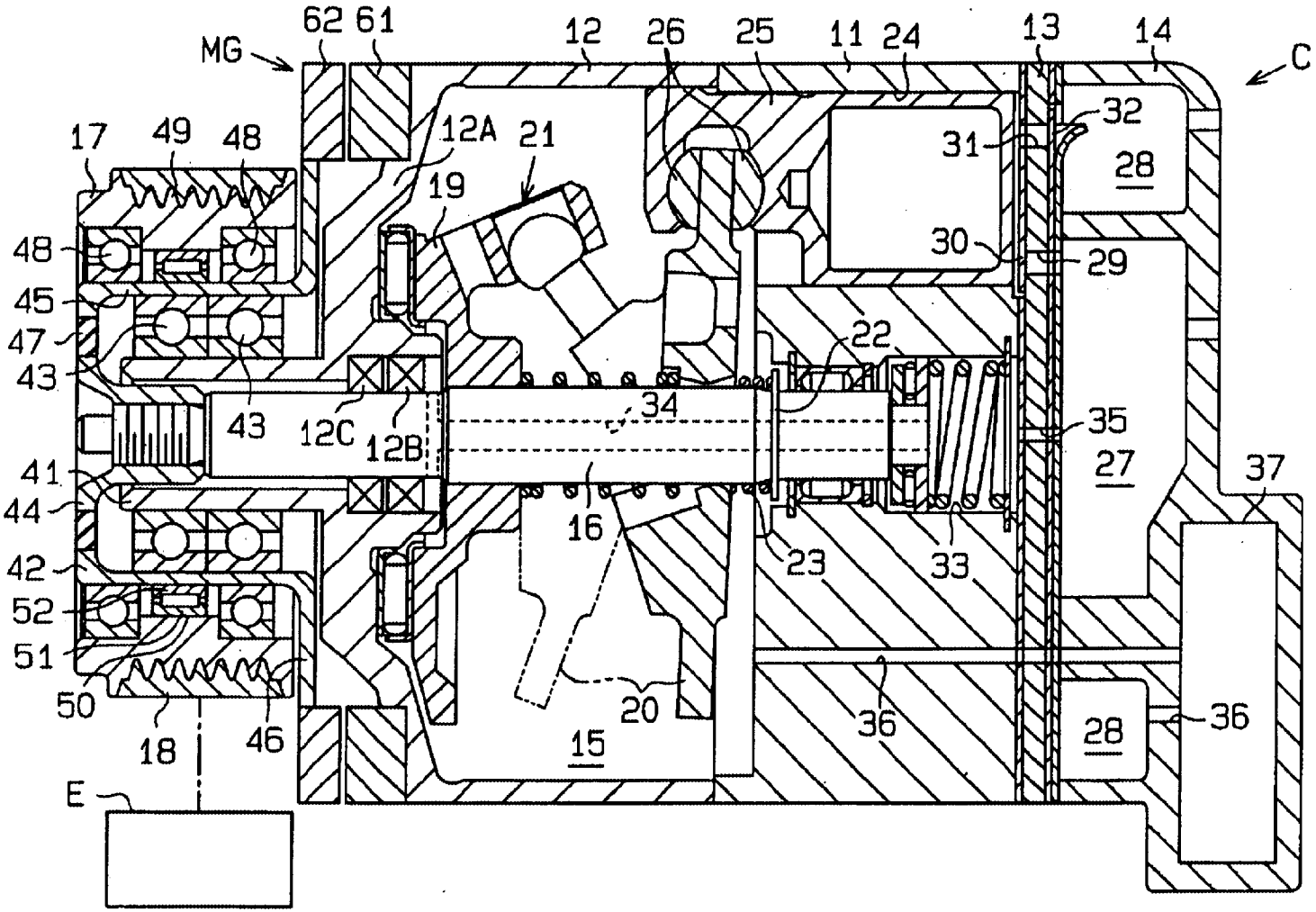
FIG. 1 is a cross-sectional view illustrating a rotational unit according to a first embodiment of the present invention.

A rotational unit according to a first embodiment of the present invention will now be described. The rotational unit includes a mechanical rotational device, which is a variable displacement swash plate type compressor C for a refrigeration circuit (refrigeration cycle) of a vehicular air conditioner in this embodiment. In FIG. 1, the left end is defined as the front end, and the right end defined as the rear end.

As shown in FIG. 1, the mechanical rotational device, or the compressor C, includes a cylinder block 11, a front housing member 12 coupled to the front end of the cylinder block 11, and a rear housing member 14 coupled to the rear end of the cylinder block 11. A valve plate assembly 13 is located between the rear housing member 14 and the cylinder block 11. The cylinder block 11, the front housing member 12, the valve plate assembly 13, and the rear housing member 14 form the housing of the compressor C.

A crank chamber 15 is defined between the cylinder block 11 and the front housing member 12. A rotary shaft, which is a drive shaft 16 in this embodiment, extends through the crank chamber 15 and is rotatably supported by the housing.

The front end portion of the drive shaft 16 is supported by the front housing member 12 with a radial bearing 12B. A cylindrical support wall 41 is formed in the front wall 12A of the front housing member 12. The front end portion of the drive shaft 16 is located in the support wall 41. The front end portion of the drive shaft 16 is coupled to an external device, or an external drive source, by a rotational member (pulley 17), and a belt 18 engaged with the rotational member. In this embodiment, the external drive source is a vehicle engine E, and the rotational member is a pulley 17. A seal member 12C is located between the front end portion of the drive shaft 16 and the front wall 12A. The seal member 12C is located outside of the radial bearing 12B. The seal member 12C prevents gas from flowing between the interior of the housing and the exterior.

The pulley 17 is connected to an electric rotational device, which is a motor generator MG in this embodiment. The motor generator MG is located in the power transmitting path between the engine E and the drive shaft 16. Also, the motor generator MG is partially outside the outer dimension of the pulley 17. When the engine E is running, the pulley 17 always transmits power from the engine E to the drive shaft 16 and the motor generator MG. At this time, the motor generator MG functions as a generator. When the air conditioner need be operated when the engine E is not running, the motor generator MG functions as a motor and drives the drive shaft 16.

A lug plate 19 is located in the crank chamber 15 and is secured to the drive shaft 16 to rotate integrally with the drive shaft 16. A cam plate, which is a swash plate 20 in this embodiment, is located in the crank chamber 15. The swash plate 20 slides along the drive shaft 16 and inclines with respect to the axis of the drive shaft 16. The swash plate 20 is coupled to the lug plate 19 by a hinge mechanism 21. The hinge mechanism 21 causes the swash plate 20 to rotate integrally with the lug plate 19 and the drive shaft 16. The hinge mechanism 21 also permits the swash plate 20 to slide along and incline with respect to the axis of the drive shaft 16.

A snap ring 22 is secured to the drive shaft 16. A spring 23 extends between the snap ring 22 and the swash plate 20. The snap ring 22 and the spring 23 determine the minimum inclination angle of the swash plate 20. The minimum inclination angle of the swash plate 20 refers to an angle at which the angle defined by the axis of the drive shaft 16 and the swash plate 20 is closest to ninety degrees.

Cylinder bores 24 (only one is shown) are formed in the cylinder block 11. The cylinder bores 24 extend parallel to the axis of the drive shaft 16. A single headed piston 25 is reciprocally accommodated in each cylinder bore 24. The front and rear opening of each cylinder bore 24 is covered by the corresponding piston 25 and the valve plate assembly 13. A compression chamber, the volume of which varies in accordance with the reciprocation of the corresponding piston 25, is defined in each bore 24. The front end of each piston 25 is connected to the periphery of the swash plate 20 through a pair of shoes 26. The rotation of the swash plate 20 is converted into reciprocation of the pistons 25.

The drive shaft 16, the lug plate 19, the swash plate 20, the hinge mechanism 21, the pistons 25, and the shoes 26 form a piston type compression mechanism.

A suction chamber 27 and a discharge chamber 28 are defined in the rear housing member 14. The front ends of the suction chamber 27 and the discharge chamber 28 are covered by the valve plate assembly 13. Sets of suction ports 29 and suction valve flaps 30 and sets of discharge ports 31 and discharge valve flaps 32 are formed in the valve plate assembly 13. Each set of the suction port 29 and the corresponding suction valve flap 30 and each set of the discharge port 31 and the corresponding discharge valve flap 30 correspond to one of the cylinder bores 24 (compression chamber). When each piston 25 moves from the top dead center position to the bottom dead center position, refrigerant gas in the suction chamber 27 flows into the corresponding cylinder bore 24 via the corresponding suction port 29 and suction valve flap 30. When each piston 25 moves from the bottom dead center position to the top dead center position, refrigerant gas in the corresponding cylinder bore 24 is compressed to a predetermined pressure and is discharged to the discharge chamber 28 via the corresponding discharge port 31 and discharge valve flap 32.

The suction chamber 27 is connected to the discharge chamber 28 through an external refrigerant circuit (not shown). Refrigerant discharged from the discharge chamber 28 flows to the external refrigerant circuit, in which heat exchange by using the refrigerant takes place. Refrigerant discharged from the external refrigerant circuit is drawn into the cylinder bores 24 through the suction chamber 27, and is then compressed.

A shaft chamber 33 is defined in the cylinder block 11 to accommodate the rear portion of the drive shaft 16. A connecting passage 34 is formed in the drive shaft 16 to communicate the front portion of the crank chamber 15 and the shaft chamber 33. A communication passage 35 is formed in the valve plate assembly 13 to communicate the suction chamber 27 with the shaft chamber 33. The shaft chamber 33, the connecting passage 34, and the communication passage 35 form a bleed passage connecting the crank chamber 15 with the suction chamber 27.

A supply passage 36 is formed in the compressor housing to connect the discharge chamber 28 with the crank chamber 15. A control valve 37 is provided in the supply passage 36 to adjust the opening degree of the supply passage 36.

The degree of opening of the control valve 37 is changed for controlling the relationship between the flow rate of high-pressure gas flowing into the crank chamber 15 through the supply passage 36 and the flow rate of gas flowing out of the crank chamber 15 through the bleed passage. The crank chamber pressure Pc is determined accordingly. In accordance with a change in the crank chamber pressure Pc, the difference between the crank chamber pressure Pc and the pressure in the compression chambers is changed, which alters the inclination angle of the swash plate 20. As a result, the stroke of each piston 25, that is, the discharge displacement, is controlled.

As shown in FIG. 1, a hub 42 is rotatably supported by the support wall 41 with a bearing 43. The hub 42 is secured to the drive shaft 16 to rotate integrally with the drive shaft 16.

The hub 42 is shaped like a cup having a flange 46 at the open end. That is, the hub 42 has an inner cylinder 44, which is coupled to the drive shaft 16, an outer cylinder 45, the flange 46, and a rubber ring 47. The rubber ring 47 is located between the inner cylinder 44 and the outer cylinder 45 and functions as a torque fluctuation reduction member. The hub 42 is secured to the drive shaft 16 by threading the inner cylinder 44 to the front end portion of the drive shaft 16. The flange 46 is integrally formed with the outer cylinder 45. The rubber ring 47 couples the inner cylinder 44 with the outer cylinder 45. The rubber ring 47 reduces fluctuations of torque transmitted between the inner cylinder 44 and the outer cylinder 45 and prevents the life of the bearings 12B, 43 from being shortened by displacement of the axis of the outer cylinder 45 from the axis of the drive shaft 16.

The pulley 17 has a substantially cylindrical shape and is rotatably supported by the outer cylinder 45 of the hub 42 with a bearing 48. The pulley 17 rotates relative to the hub 42 and the front housing member 12. The circumference of the pulley 17 functions as a power transmitting mechanism, which is a belt holder 49 in this embodiment. The belt holder 49 has a saw-tooth cross section. A belt 18, which is connected to the engine E, is wound about the belt holder 49.

A one-way clutch 50 is arranged between the pulley 17 and the outer cylinder 45 of the hub 42. In other words, the one-way clutch 50 is located inward of the pulley 17. An outer clutch member 51 is fixed to the inner circumference of the pulley 17. An annular inner clutch member 52 is fixed to the outer circumference of the outer cylinder 45 of the hub 42. The inner clutch member 52 is surrounded by the outer clutch member 51.

Figure 2A:
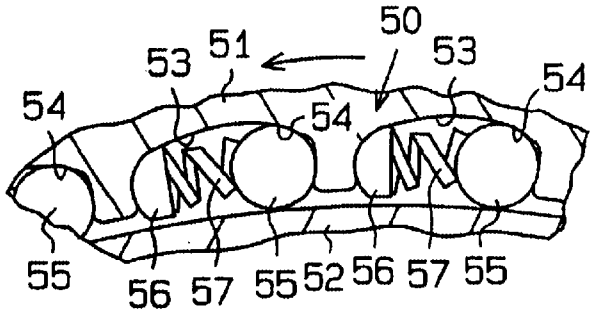
FIGS. 2(*a*) and 2(*b*) are enlarged partial cross sectional views illustrating the one-way clutch used in the rotational unit shown in FIG. 1.
Figure 2B:
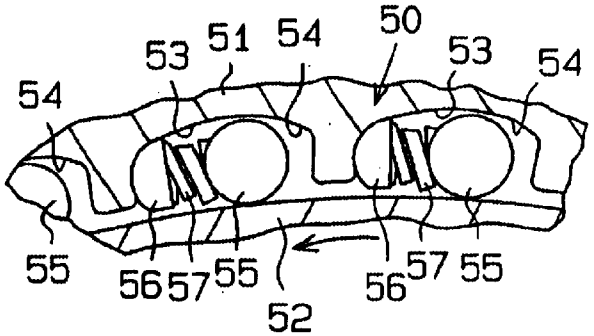

As shown in FIGS. 2(*a*) and 2(*b*), recesses 53 are formed in the inner circumference of the outer clutch member 51. The recesses 53 are arranged at equal angular intervals about the axis of the drive shaft 16. A cam surface 54 is formed on the right end, or the clockwise end, of each recess 53 as viewed in FIGS. 2(*a*) and 2(*b*). A roller 55, which extends parallel with the drive shaft 16, is accommodated in each recess 53. Each roller 55 can be moved from a position where the roller 55 is engaged with the cam surface 54 as shown in FIG. 2(*a*) to a position where the roller 55 is disengaged from the cam surface 54 as shown in FIG. 2(*b*).

A spring seat 56 is provided in each recess 53 at the end opposite to the cam surface 54. A spring 57 is arranged between each spring seat 56 and the corresponding roller 55. Each spring 57 urges the corresponding roller 55 toward the corresponding cam surface 54.

As shown in FIG. 2(*a*), when the pulley 17 is rotated by the power transmission from the engine E in the direction indicated by an arrow, each roller 55 is urged toward the corresponding cam surface 54 by the corresponding spring 57. Then, the rollers 55 transmit power between the cam surfaces 54 and the outer circumference of the inner clutch member 52, which rotates the hub 42 in the same direction as the rotation of the pulley 17. That is, when the engine E is running, the force of the engine E is transmitted to the drive shaft 16 through the hub 42. Thus, the drive shaft 16 is always rotated when the engine E is running.

If the hub 42 is rotated in the direction indicated by the arrow in FIG. 2(*b*) when the engine E is not running and the pulley 17 is not rotating, the pulley 17 is rotated in the opposite direction relative to the hub 42. Therefore, each roller 55 is disengaged from the corresponding cam surface 54. Thus, the hub 42 runs idle with respect to the pulley 17.

The motor generator MG is formed of an induction machine, which functions as a rotational electric device having no permanent magnets. As shown in FIG. 1, part of the motor generator MG is located axially between the belt holder 49 of the pulley 17 and the front wall 12A of the compressor housing.

The motor generator MG includes the outer cylinder 45 of the hub 42, a stator 61 and a rotor 62. The stator 61 is fixed to the front surface of the front wall 12A of the front housing member 12. The stator 61 is located at the outermost position in the radial direction of the drive shaft 16 without radially protruding outward from the outer circumference (the maximum diameter portion) of the front housing member 12. The stator 61 includes a stationary iron core and a coil wound about the core.

The rotor 62 of the motor generator MG is fixed to the peripheral portion of the flange 46 of the hub 42 to face the stator 61. Like the stator 61, the rotor 62 is located at the outermost position in the radial direction of the drive shaft 16 without radially protruding outward from an imaginary cylinder that extends axially from the circumference (the maximum diameter portion) of the front housing member 12. The rotor 62 includes a rotational iron core and a rotary conductor, which is fixed to the rotational core.

The coil of the stator 61 is connected to a battery (not shown) by a drive circuit (not shown) having an inverter and a converter. Based on commands from a controller (not shown), the drive circuit controls charging of electricity from the coil to the battery and supply of electricity from the battery to the coil.

The drive circuit is controlled by the controller. When the battery need to be charged while the engine E is running, the drive circuit causes the motor generator MG to function as an induction generator for generating electricity. That is, when the hub 42 (the rotor 62) is rotated by the engine E, electricity is generated in the coil. The generated electricity is sent to the battery through the drive circuit to charge the battery.

When the battery does not need to be charged while the engine E is running, the drive circuit causes the motor generator MG not to generate electricity. Specifically, the drive circuit is controlled by the controller such that no excitation current is supplied to the motor generator MG, which functions as an induction machine.

In this state, no magnetic force exists between the stator 61 and the rotor 62. Therefore, even if the rotor 62 is rotated by the force of the engine E, energy loss, such as heat due to excitation loss of the stator 61 and the rotor 62, does not occur. Also, even if the rotor 62 is being rotated by the force of the engine E, torque fluctuations of the drive shaft 16 due to magnetic force are not produced.

When the controller judges that air conditioning (cooling) is needed based on external information, the drive circuit causes the motor generator MG to function as an induction motor. That is, the drive circuit supplies electricity to the coil to generate rotational force in the rotor 62. The rotational force is transmitted to the drive shaft 16 through the hub 42. This permits the passenger compartment to be air conditioned even if the engine E is not running.

When the motor generator MG functions as a motor and rotates the hub 42, the one-way clutch 50 prevents power from being transmitted between the hub 42 and the pulley 17. Therefore, the power of the motor generator MG is not transmitted to the engine E.

The compressor C, the bearing 43, the hub 42, the bearing 48, the one-way clutch 50, the pulley 17, the motor generator MG, the drive circuit, the battery, and the controller form the rotational unit.

This embodiment has the following advantages.

(1) The motor generator MG is coaxial with the drive shaft 16 and is located at the front side of the front wall 12A of the front housing member 12. Also, part of the motor generator MG is radially outside of the belt holder 49. Compared to a case where the motor generator MG is located about the compressor housing and at the rear side of the front wall 12A, the first embodiment decreases the size of the rotational unit in the axial direction. The size of either of the motor generator MG or the belt holder 49 does not limit the size of the other. This permits the size of the motor generator MG to be increased and the size of the belt holder 49 to be decreased. Therefore, for example, the power of the motor generator MG can be easily increased while minimizing the size of the belt holder 49.

(2) Part of the motor generator MG is located axially between the belt holder 49 and the compressor housing. Compared to a case where the entire motor generator MG is located at the opposite side of the belt holder 49, the first embodiment permits the size of the rotational unit to be axially reduced.

(3) Part of the motor generator MG is located between the front wall 12A of the front housing member 12 and the belt holder 49 such that the motor generator MG does not protrude radially outward from the compressor housing. Therefore, compared to a case where part of or the motor generator MG or the entire motor generator MG is located on the outer circumference of the compressor housing, the first embodiment permits the size of the rotational unit to be decreased in the radial direction.

Also, in the first embodiment, the stator 61 and the rotor 62 are located at the outermost position without protruding radially outward from the outer circumference of the front housing member 12. Therefore, the power of the motor generator MG can be increased while minimizing the radial dimension of the rotational unit.

(4) The one-way clutch 50 is located between the drive shaft 16 and the pulley 17, which are in the power transmission path. Compared to a case where an electromagnetic clutch is located between the drive shaft 16 and the pulley 17, the parts used in the mechanism for disconnecting the power transmission between the drive shaft 16 and the pulley 17 are light. This decreases the size of the pulley 17 and minimizes the size and the weight of the rotational unit. Further, since there is no need to perform a control procedure for disengaging an electromagnetic clutch, the structure of the rotational unit is simple.

(5) The rubber ring 47 is located between the inner cylinder 44 and the outer cylinder 45. The rubber ring 47 reduces the torque fluctuations between the inner cylinder 44 and the outer cylinder 45. The rubber ring 47 also hinders the life of the bearings 12B, 43 from being shortened by displacement of the axis of the outer cylinder 45 from the axis of the drive shaft 16.

(6) The motor generator MG is an induction machine having no permanent magnet. Compared to a case where a motor generator having permanent magnets is used, the first embodiment reduces the cost.

This structure permits magnetic force between the stator 61 and the rotor 62 to be eliminated. Therefore, when the rotor 62 is rotated by the force of the engine E, energy loss such as heat due to excitation loss of the stator and the rotor 62 is prevented.

Since the magnetic force between the stator 61 and the rotor 62 can be eliminated, torque fluctuations in the drive shaft 16 due to magnetic force are prevented when the rotor 62 is rotated by external force. Therefore, rotational vibration of the drive shaft 16 is suppressed.

This structure can prevent the motor generator MG from generating electricity even if the rotor 62 is being rotated by the force of the engine E. The structure therefore has the following advantages. For example, suppose a condenser is connected to the battery in parallel for smoothing electricity that is generated by the motor generator MG and is then commutated. In this case, the battery is disconnected from the condenser when, for example, the battery need not be charged. At this time, even if the rotor 62 is being rotated by the force of the engine E, the condenser is prevented from being damaged by excessive voltage between the terminals of the condenser. The structure for preventing the voltage between the condenser terminals from being excessive is simple, which simplifies the structure of the rotational unit.

Figure 3:
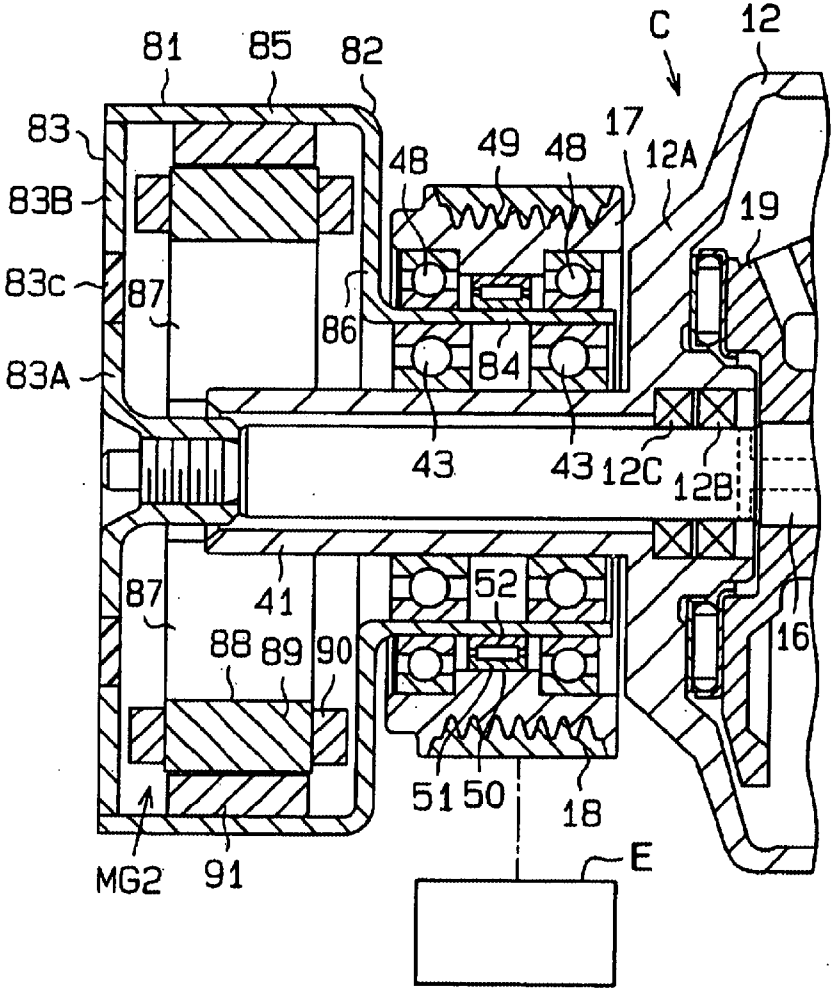
FIG. 3 is an enlarged cross-sectional view illustrating a rotational unit according to a second embodiment of the present invention.

FIG. 3 illustrates a second embodiment according to the present invention. The second embodiment has the same construction as the first embodiment except for the location and the structure of a motor generator MG2 and the structure of a hub 81. Thus, like or the same reference numerals are given to those components that are like or the same as the corresponding components of the first embodiment.

As shown in FIG. 3, a cylindrical support wall 41 is formed at the front wall 12A of the front housing member 12. The support wall 41 of the second embodiment extends further forward as compared to that of the first embodiment.

The hub 81 is located between the pulley 17 and the drive shaft 16 in the power transmission path. The hub 81 includes a first hub member 82 and a second hub member 83.

The first hub member 82 includes a small cylinder 84, a large cylinder 85, and a flange 86. The small cylinder 84 is fitted about the outer ring of the bearing 43 and is located of the pulley 17. The inner diameter of the large cylinder 85 is greater than the maximum outer diameter of the pulley 17. The flange 86 couples the small cylinder 84 to the large cylinder 85.

The pulley 17 is rotatably supported by the small cylinder 84 with the bearing 48 and the one-way clutch 50 and rotates relative to the hub 81. The second hub member 83 includes an inner hub member 83A, a disk-like outer hub member 83B and a torque fluctuation reduction member, which is a rubber ring 83C. The rubber ring 83C is located between the boss 83A and the outer hub member 83B. A boss is formed in the center of the inner hub member 83A. The second hub member 83 is secured to the drive shaft 16 by threading the boss to the front end portion of the drive shaft 16. The rubber ring 83C is located between the inner hub member 83A and the outer hub member 83B to couple the members 83A, 83B to each other. The diameter of the circumference of the outer hub member 83B is equal to the inner diameter of the large cylinder 85 of the first hub member 82. The second hub member 83 is detachably attached to the first hub member 82 to cover the front opening of the large cylinder 85.

In the state where the second hub member 83 is secured to the first hub member 82, the hub members 83, 82 rotate integrally. The rubber ring 83C reduces fluctuations of torque transmitted between the inner hub member 82A and the outer hub member 83B. Further, in the state where the outer hub member 83B is attached to the first hub member 82, the rubber ring 83C prevents the life of the bearings 12B, 43 from being shortened by the displacement of the axis of the outer hub member 83B from the axis of the drive shaft 16.

The main part of an electric rotational device, which is the motor generator MG2 in this embodiment, is located at the opposite side of the pulley 17 from the compressor housing. The motor generator MG2 includes the first hub member 82, stator supports 87, a stator 88, and a rotor 91. Therefore, part of the motor generator MG2 is outside the outer dimension of the pulley 17.

The stator supports 87 (only two of them are shown in FIG. 3) are fixed to the distal end of the support wall 41. The stator supports 87 extend outward in the radial direction of the drive shaft 16. The stator 88 is secured to the distal ends of the stator supports 87. The stator 88 includes a stationary iron core 89 and a coil 90 wound about the core 89.

The rotor 91 is mounted on the inner circumference of the large cylinder 85 of the first hub member 82 to face the stator 88. The rotor 91 includes a rotational iron core and a rotary conductor fixed to the iron core.

As in the first embodiment, the coil 90 is connected to a battery (not shown) by a drive circuit (not shown) having an inverter and a converter. Based on commands from a controller (not shown), the drive circuit controls charging electricity from the coil 90 to the battery and supply of electricity from the battery to the coil 90.

The compressor C, the bearing 43, the hub 81, the bearing 48, the one-way clutch 50, the pulley 17, the motor generator MG2, the drive circuit, the battery, and the controller form the rotational unit.

The rotational unit of the second embodiment has the advantages (1), (4), and (6) of the rotational unit of the first embodiment. Additionally, the rotational unit of the second embodiment has the following advantages.

(7) The motor generator MG2 (except the small cylinder 84) is located on the opposite side of the belt holder 49 from the compressor housing. Therefore, the compressor C does not hamper the maintenance of the motor generator MG2. That is, the structure of the second embodiment improves the efficiency of maintenance, which is performed from, for example, the front side after detaching the second hub member 83 from the first hub member 82.

(8) The rubber ring 83C is located between the inner hub member 83A and the outer hub member 83B. The rubber ring 83C reduces the torque fluctuations between the inner hub member 83A and the outer hub member 83B. When the outer hub member 83B is attached to the first hub member 82, the rubber ring 83C hinders the life of the bearings 12B, 43 from being shortened by displacement of the axis of the outer hub member 83B from the axis of the drive shaft 16.

Figure 4:
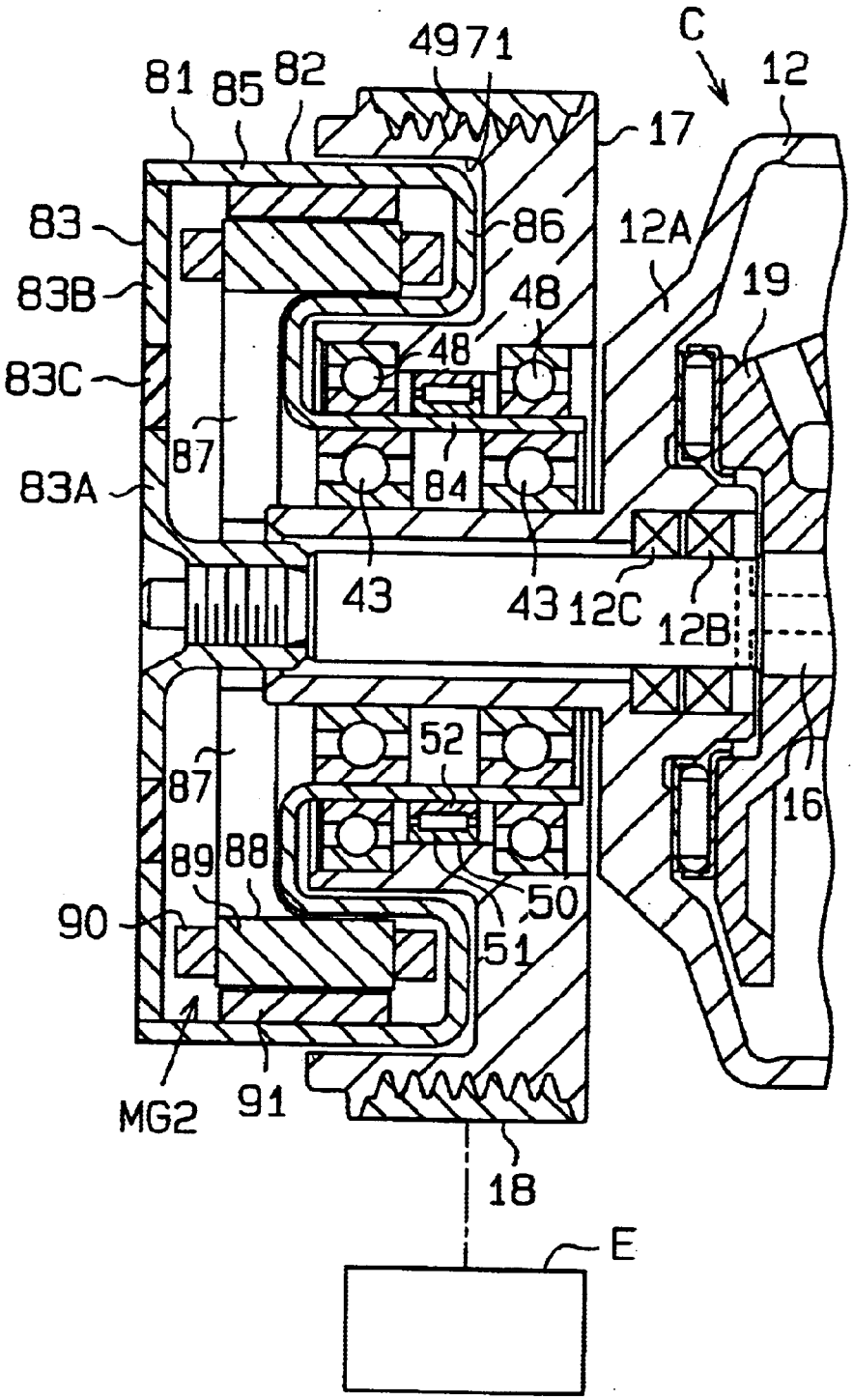
FIG. 4 is an enlarged cross-sectional view illustrating a rotational unit according to a third embodiment of the present invention.

FIG. 4 illustrates a third embodiment according the present invention. The third embodiment has the same construction as the second embodiment except for the location of the motor generator MG2 and the structure of the pulley 17. Thus, like or the same reference numerals are given to those components that are like or the same as the corresponding components of the second embodiment.

As shown in FIG. 4, the diameter of a pulley 17 of the third embodiment is greater than the pulley 17 of the second embodiment. An annular recess 71 is formed on the front side of the pulley 17. The recess 71 is formed radially inward of the belt holder 49.

The rear portion of the motor generator MG2 is located radially inward of the belt holder 49. In other words, part of the motor generator MG2 that includes the stator 88 and the rotor 91 overlaps the belt holder 49 in the axial direction. The maximum outer diameter of the motor generator MG2 (the diameter of the circumference of the rotor 91) is smaller than the maximum outer diameter of the pulley 17. The radially outer portion of the flange 86 bulges rearward from the radially inner portion so that part of the motor generator MG2 is located radially inward of the bulging portion.

In addition to the advantages (4), (6), (7), and (8), the third embodiment has the following advantage.

(9) The motor generator MG2 is coaxial with the drive shaft 16 and is located forward of the front wall 12A of the front housing member 12. Part of the motor generator MG2 overlaps the belt holder 49 in the axial direction. Compared to a case where the motor generator MG is located rearward of the front wall 12A and about the housing of the compressor housing, the third embodiment reduces the size of the rotational unit in the radial direction of the drive shaft 16. Also, compared to a case where the motor generator MG2 is located outside the outer dimension of the belt holder 49 in the axial direction, the third embodiment reduces the size of the rotational unit in the axial direction.

It should be apparent to those skilled in the art that the present invention may be embodied in many other specific forms without departing from the spirit or scope of the invention. Particularly, it should be understood that the invention may be embodied in the following forms.

In the first embodiment, the stator 61 and the rotor 62 are located at the outermost position without protruding radially outward from the circumference of the front housing member 12. However, the stator 61 and the rotor 62 may be located radially inward of the positions of the first embodiment.

In the first embodiment, the rubber ring 47 is fixed to the inner cylinder 44 and the outer cylinder 45. However, the rubber ring 47 may be replaced with a detachable member that discontinues power transmission between the inner cylinder 44 and the outer cylinder 45 when an excessive load torque acts on the cylinders 44, 45.

In the first embodiment, the rubber ring 47 may be omitted, and the inner cylinder 44 may be directly coupled to the outer cylinder 45.

In the second embodiment, the inner diameter of the large cylinder 85 of the hub 81 may be smaller than the maximum diameter of the pulley 17.

In the second embodiment, the rubber ring 83C is fixed to the inner hub member 83A and the outer hub member 83B. However, the rubber ring 83C may be replaced with a detachable member that discontinues power transmission between the inner hub member 83A and the outer hub member 83B when an excessive load torque acts on the hub members 83A and 83B.

In the second embodiment, the rubber ring 83C may be omitted, and the inner hub member 83A may be directly coupled to the outer hub member 83B.

In the third embodiment, the outer diameter of the front portion of the motor generator MG2 may be partly greater than the maximum diameter of the pulley 17.

In the illustrated embodiments, the rubber rings 47, 83C are used as a torque fluctuation reduction member. The rubber rings 47, 83C may be replaced by any structure as long as the structure reduces torque fluctuations.

In the illustrated embodiments, the one-way clutch 50 having the outer clutch member 51, the inner clutch member 52, and the rollers 55 is used. However, the one-way clutch 50 may be replaced by any structure as long as the structure permits power transmission from the pulley 17 to the drive shaft 16 and prevents power transmission from the motor generator MG to the pulley 17.

In the illustrated embodiment, the present invention is applied to the motor generators MG, which include an induction machine having no permanent magnets. However, the present invention may be applied to a motor generator having permanent magnets. Compared to a motor generator having no permanent magnets, a motor generator having permanent magnets can produce greater power.

In the illustrated embodiments, the electric rotational device is an induction machine having no permanent magnets. However, the electric rotational device may be a reluctance motor having no permanent magnets. Although not capable of generating electricity, a reluctance motor having no permanent generates a relatively great starting torque as compared to an induction machine having no permanent magnets. That is, the reluctance motor is advantageous in generating a greater torque. The reluctance motor may be, for example, a switched reluctance motor (SR motor) or a variable reluctance motor (VR motor).

In the illustrated embodiments, an induction machine having no permanent magnets is used as the electric rotational device. However, the present invention may be applied to a stepping motor having no permanent magnets. Since a stepping motor generates a greater starting torque compared to an induction machine, the stepping motor is therefore advantageous in generating greater torque.

In the illustrated embodiments, the mechanical rotational device is applied the compressor C having single headed pistons, which compresses refrigerant at one side of each piston. However, the mechanical rotational device may be a double-headed piston type compressor. A double-headed piston type compressor has pairs or front and rear cylinder bores. Each piston corresponds to one of the pairs of the front and rear cylinder bores and compresses gas in the corresponding cylinder bores.

In the illustrated embodiments, the present invention is applied to the compressor C, in which the cam plate (swash plate 20) rotates integrally with the drive shaft 16. However, the present invention may be replaced with a wobble type compressor, in which a cam plate rotates relative to a drive shaft.

In the illustrated embodiments, the present invention may be applied to a fixed displacement compressor, in which the stroke of pistons is not variable.

In the illustrated embodiment, the present invention is applied to the piston type compressor C, in which pistons 25 reciprocate. However, the present invention may be applied to a rotary compressor such as a scroll type compressor.

In the illustrated embodiment, the present invention is applied to the compressor C. However, the present invention may be applied to any type of rotary apparatus as long as the apparatus drives a rotary shaft by using driving force transmitted through a rotor or by using driving force of an electric rotational device.

Therefore, the present examples and embodiments are to be considered as illustrative and not restrictive and the invention is not to be limited to the details given herein, but may be modified within the scope and equivalence of the appended claims.

What is claimed is:

1. A rotational unit, comprising:

a mechanical rotational device having a housing, wherein the housing includes a front wall;

a rotary shaft having an end portion that protrudes from the front wall of the housing;

an electric rotational device coaxial with the rotary shaft, wherein the electric rotational device coupled to the end portion of the rotary shaft and functions as at least one of a motor and a generator;

a rotational member coupled to the rotary shaft, wherein the rotational member has a power transmitting mechanism for transmitting power between the rotational unit and an external device; and a one-way clutch located in a power transmitting path between the rotary shaft and the rotational member, wherein the one-way clutch is located inward of the rotational member, wherein when the rotational member rotates in a first direction, the one-way clutch connects the rotary shaft to the rotational member, and when the rotational member rotates in a second direction opposite to the first direction relative to the rotary shaft, the one-way clutch causes the rotary shaft to run idle with respect to the rotational member;

wherein the electric rotational device is located on or forward of the front wall of the housing, and wherein at least part of the electric rotational device is located outside of the power transmitting mechanism.

2. The rotational unit according to claim 1, wherein the electric rotational device is located at the opposite side of the power transmitting mechanism from the housing of the mechanical rotational device.

3. The rotational unit according to claim 2, wherein the electric rotational device includes a stator, a rotor, and a hub, the hub rotatably supporting the rotor, wherein part of the stator and part of the rotor overlap the power transmitting mechanism in the axial direction, and wherein the maximum diameter of the electric rotational device is smaller than the maximum diameter of the rotational member.

4. The rotational unit according to claim 1, wherein the electric rotational device is located between the front wall of the housing and the power transmitting mechanism.

5. The rotational unit according to claim 4, wherein the electric rotational device is located within the maximum diameter of the housing.

6. The rotational unit according to claim 1, wherein a reduction member for reducing fluctuations of torque is located in the power transmitting path between the rotary shaft and the rotational member.

7. The rotational unit according to claim 1, wherein the mechanical rotational device is a compressor, which is part of a refrigeration cycle of an air conditioner.

8. The rotational unit according to claim 1, wherein the electric rotational device has no permanent magnet.

9. The rotational unit according to claim 1, wherein the electric rotational device is an induction machine.

10. The rotational unit according to claim 9, wherein the electric rotational device is a reluctance motor or a stepping motor.

11. A rotational unit, comprising:

a compressor having a housing, wherein the housing includes a front wall;

a rotary shaft having an end portion that protrudes from the front wall of the housing;

an electric rotational device coaxial with the rotary shaft, wherein the electric rotational device is coupled to the end portion of the rotary shaft and functions as at least one of a motor and a generator;

a rotational member coupled to the rotary shaft, wherein the rotational member has a power transmitting mechanism for transmitting power between the rotational unit and an external drive source; and a one-way clutch located in a power transmitting path between the rotary shaft and the rotational member, wherein the one-way clutch is located inward of the rotational member, wherein when the rotational member rotates in a first direction, the one-way clutch connects the rotary shaft to the rotational member, and when the rotational member rotates in a second direction opposite to the first direction relative to the rotary shaft, the one-way clutch causes the rotary shaft to run idle with respect to the rotational member;

wherein the electric rotational device is located on or forward of the front wall of the housing, and wherein at least part of the electric rotational device is located outside the outer dimension of the power transmitting mechanism.

12. The rotational unit according to claim 11, wherein the electric rotational device is located at the opposite side of the power transmitting mechanism from the housing of the mechanical rotational device.

13. The rotational unit according to claim 12, wherein the electric rotational device includes a stator, a rotor, and a hub, the hub rotatably supporting the rotor, wherein part of the stator and part of the rotor overlap the power transmitting mechanism in the axial direction, and wherein the maximum diameter of the electric rotational device is smaller than the maximum diameter of the rotational member.

14. The rotational unit according to claim 11, wherein the electric rotational device is located between the front wall of the housing and the power transmitting mechanism.

15. The rotational unit according to claim 14, wherein the electric rotational device is located within the maximum diameter of the housing.

16. The rotational unit according to claim 11, wherein a reduction member for reducing fluctuations of torque is located in the power transmitting path between the rotary shaft and the rotational member.

* * * * *